US010968000B2

(12) United States Patent
Carlson et al.

(10) Patent No.: US 10,968,000 B2
(45) Date of Patent: Apr. 6, 2021

(54) PACKAGING SYSTEM AND METHOD WITH CONTROLLED DUNNAGE DISPENSING

(71) Applicant: Ranpak Corp., Concord Township, OH (US)

(72) Inventors: Daniel L. Carlson, Ravenna, OH (US); Paul F. Deimling, Fairport Harbor, OH (US); Kevin W. Park, Chardon, OH (US); Derek M. Gabrielsen, Cleveland, OH (US)

(73) Assignee: Ranpak Corp., Concord Township, OH (US)

( * ) Notice: Subject to any disclaimer, the term of this patent is extended or adjusted under 35 U.S.C. 154(b) by 332 days.

(21) Appl. No.: 16/061,175

(22) Filed: Jun. 11, 2018

(65) Prior Publication Data

US 2020/0198822 A1 Jun. 25, 2020

Related U.S. Application Data

(62) Division of application No. 12/935,100, filed as application No. PCT/US2009/045652 on May 29, 2009, now Pat. No. 9,994,346.

(Continued)

(51) Int. Cl.

| | |
|---|---|
| ***B65B 55/20*** | (2006.01) |
| ***B65B 57/12*** | (2006.01) |
| *B65B 61/20* | (2006.01) |

(52) U.S. Cl.

CPC ..... *B65B 55/20* (2013.01); *B65B 57/12* (2013.01); *B65B 61/20* (2013.01)

(58) Field of Classification Search

CPC ..... B65B 55/20; B65B 57/12

(Continued)

(56) References Cited

U.S. PATENT DOCUMENTS

| | | | |
|---|---|---|---|
| 3,513,444 | A | 5/1970 | Henderson et al. |
| 3,588,480 | A | 6/1971 | Unger et al. |

(Continued)

FOREIGN PATENT DOCUMENTS

| | | |
|---|---|---|
| WO | 98/56663 | 12/1998 |
| WO | 2006/017602 A1 | 2/2006 |

(Continued)

OTHER PUBLICATIONS

International Search Report and Written Opinion of International Application No. PCT/US2009/045652, dated Nov. 4, 2009.

(Continued)

*Primary Examiner* — Chelsea E Stinson

(74) *Attorney, Agent, or Firm* — Renner, Otto, Boisselle & Sklar, LLP

(57) ABSTRACT

A packaging method includes the steps of (a) detecting whether a height (104) of contents (105) in a container (106) exceeds a predetermined height (112), and (b) indicating how much dunnage to dispense based on predetermined criteria, including whether a detected height exceeds a predetermined height that is less than a height of the container. The indicating step includes indicating a quantity of dunnage to dispense selected from a plurality of predetermined quantities of dunnage. If no detected height is greater than the predetermined height, the indicating step includes indicating that a regular amount of dunnage should be dispensed. And if a detected height is greater than the predetermined height, the indicating step includes indicating that either zero or less than the regular amount of dunnage should be dispensed. The detecting step also can include detecting whether any contents in the container have a height above the height of the container.

13 Claims, 2 Drawing Sheets

Related U.S. Application Data

(60) Provisional application No. 61/057,325, filed on May 30, 2008.

(58) Field of Classification Search
USPC ..... 53/473
See application file for complete search history.

(56) References Cited

U.S. PATENT DOCUMENTS

| | | | | |
|---|---|---|---|---|
| 3,819,918 | A | 6/1974 | Hale | |
| 4,924,506 | A | 5/1990 | Crossley et al. | |
| 5,719,678 | A | 2/1998 | Reynolds et al. | |
| 6,877,297 | B2 | 4/2005 | Armington et al. | |
| 7,161,688 | B1 | 1/2007 | Bonner et al. | |
| 7,584,592 | B2 * | 9/2009 | Gabrielson | B65B 55/20 53/445 |
| 7,814,734 | B2 * | 10/2010 | Bilkie, Jr. | B65B 55/20 53/473 |
| 2005/0050848 | A1 | 3/2005 | Harding | |
| 2008/0098699 | A1 | 5/2008 | Cheich et al. | |

FOREIGN PATENT DOCUMENTS

| | | | | |
|---|---|---|---|---|
| WO | 2006/050354 | | 5/2006 | |
| WO | 2007/022480 | A1 | 2/2007 | |
| WO | WO-2007022480 | A1 * | 2/2007 | B65B 55/20 |
| WO | 2007/121169 | | 10/2007 | |
| WO | 2009/155101 | | 12/2009 | |

OTHER PUBLICATIONS

International Preliminary Report on Patentability of International Application No. PCT/US2009/045652, dated Jul. 29, 2010.

* cited by examiner

PACKAGING SYSTEM AND METHOD WITH CONTROLLED DUNNAGE DISPENSING

This application is a divisional of U.S. patent application Ser. No. 12/935,100, filed Sep. 28, 2010 which is a national phase of International Application No. PCT/US2009/045652, filed May 29, 2009, and published in the English language as WO 2009/155101 A1, which claims the benefit of U.S. Provisional Patent Application No. 61/057,325, filed May 30, 2008, which are incorporated herein by reference.

FIELD OF THE INVENTION

The present invention is related to a system and method for packaging one or more products in a container for shipment, and more particularly to a system and method controlled dispensing of dunnage to fill a void in the container before shipment.

BACKGROUND

Packaging systems typically add dunnage to a shipping container to protect products being shipped. The dunnage fills a void in the container left over after the products have been placed in the container, and cushions the products and/or prevents or minimizes movement of the products in the container during shipment.

Some packaging systems, particularly when dispensing dunnage to random container sizes and/or containers packed with random size and/or shape objects, scan a container and calculate a void volume and then determine a quantity of dunnage to dispense to fill the void in the container. The system then instructs a dunnage dispenser to dispense the determined quantity of dunnage to the void.

When an automated system fills a series of containers having the same size, variations in the void volume can be within a range of compressibility of the dunnage. This means that dunnage can be dispensed to most containers without scanning each container, and calculating the void volume, and then determining how much dunnage to dispense to each container. Within the range of compressibility, the same quantity of dunnage can be automatically dispensed to every container.

SUMMARY

An exception, when dunnage should not be automatically dispensed to a void in a container, is when the container is sufficiently full that it cannot accommodate any dunnage. The void volume is too small to receive even compressed dunnage. While a packer ordinarily can determine generally how full one container is relative to another, a packer does not measure the void volume to determine whether it is sufficient to receive dunnage.

A packer can easily judge when a container is about half full or three-quarters full, but cannot readily determine when the void volume is less than 100 millimeters cubed, for example, particularly when the void volume defined by the container contents has an irregular shape. An automated system generally minimizes or eliminates the packer's or operator's responsibilities for placing dunnage in a container, freeing the operator to perform other tasks.

The present invention provides a packaging system and method that determine whether dunnage can be added to a container and bypasses the dunnage dispenser when no dunnage is needed. All without calculating the void volume. This prevents a container from being overfilled and preserves dunnage for containers that require dunnage. A packaging system provided by the present invention generally reduces or eliminates the time and expense for calculating the void volume and the additional equipment to do so.

An exemplary packaging system provided in accordance with the invention includes (a) a sensor that detects a height of contents in a container, and (b) a controller connectable to the sensor that indicates how much dunnage to dispense based on predetermined criteria, where the predetermined criteria includes a comparison between a detected height and a predetermined height that is less than a height of the container.

And an exemplary packaging method provided by the invention includes the steps of (a) detecting a height of contents in a container, and (b) indicating how much dunnage to dispense based on predetermined criteria, including comparing a detected height and a predetermined height that is less than a height of the container.

Another exemplary packaging system provided by the invention includes (a) means for detecting a height of contents in a container, and (b) means for indicating how much dunnage to dispense based on predetermined criteria, including comparing a detected height and a predetermined height that is less than a height of the container.

Yet another exemplary packaging system provided by the invention includes (a) a sensor that detects contents in a container that have a height above a predetermined height; and (b) a controller connectable to the sensor that indicates a quantity of dunnage to dispense based on whether the sensor detected contents of the container above the predetermined height.

A corresponding method includes the steps of (a) detecting whether contents in a container have a height above a predetermined height; and (b) indicating a quantity of dunnage to dispense based on whether the detecting step detected contents of the container above the predetermined height.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Although a packer generally can determine the relative degree to which a container is filled, a packer does not calculate the void volume to determine whether the void volume is either large enough to receive dunnage or too small to receive dunnage. Dunnage generally can be compressed from its normal lofted condition to a smaller compressed condition. One way to compress the dunnage is to close the container in which it has been placed, by closing flaps over an open side of the container or closing the open side with a lid, for example. The packer only sees the dunnage in its lofted condition, however, which makes it more difficult for the packer to determine whether a void volume is too small to receive dunnage in its compressed condition.

Our invention provides a packaging system and method that indicate whether dunnage can be added to a container to avoid overfilling the container, while ensuring that dunnage is added to containers that can accommodate it.

Figure 1:
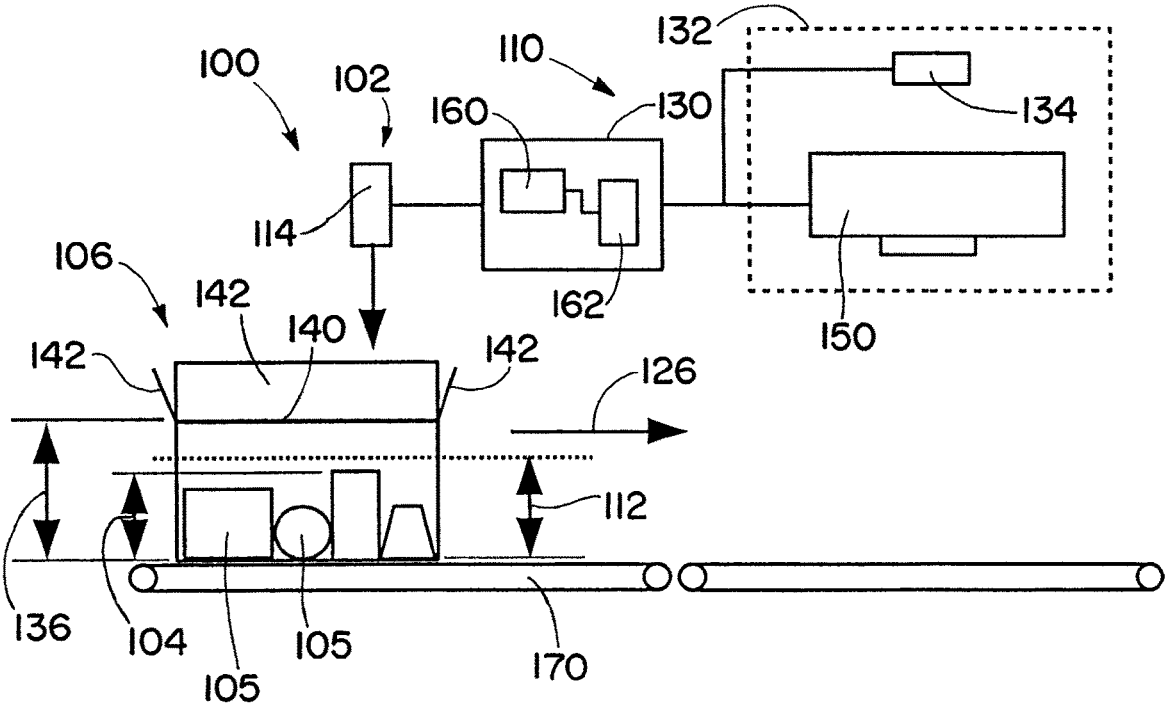
FIG. 1 is a schematic elevation view of a system provided in accordance with the invention.

Referring now in detail to the drawings, and initially to FIG. 1, an exemplary packaging system 100 includes detecting means 102 for detecting a height 104 of contents 105 in a container 106 having a maximum height 104 within a predetermined distance from the detecting means, and indicating means 110 for indicating how much dunnage to dispense based on predetermined criteria. The predetermined criteria can include a comparison of a detected height and a predetermined height 112 that is less than a height of the container 106, for example. The height 136 of the container 106 is the height of the container in its closed condition, typically defined by either a fold line 140 of a regular slotted container having flaps 142 that fold over the open side of the container 106 to close it, or the top edge of a shoebox-style container on which a lid is placed to close the open side of the container. The predetermined height 112 is less than the height 136 of the container 106, and typically is the height above which a normal amount of dunnage cannot be accommodated in the container 106.

The detecting means 102 typically includes a sensor 114. The sensor 114 generally detects objects within a predetermined distance from the sensor. The sensor can either indicate that an object does or does not extend above a predetermined height, or the sensor can measure the height, depending on the type of sensor and its settings. Exemplary sensors include a pressure-sensitive plunger, an acoustic sensor, a laser or other light-based sensor, etc. The sensor 114 also can include a plurality of sensing elements 124 (FIG. 3) arrayed across a path 126 of the container 106 that look down into an open side of the container 106.

An exemplary indicating means 110 includes a controller 130 connectable to the sensor 114. The sensor 114 can be hardwired to the controller 130 or connected wirelessly. The sensor 114 also can communicate with the controller either continuously or intermittently. A typical controller 130 includes a processor 160 and a memory 162. The memory can store a plurality of quantities of dunnage, and the controller can indicate a quantity of dunnage to dispense that is selected from the predetermined quantities of dunnage using the predetermined criteria. These predetermined quantities of dunnage to dispense that are stored in the memory can include zero dunnage, a minimal amount of dunnage, and a regular amount of dunnage that is greater than the minimal amount.

The indicating means 110 also can include an output device 132 connected to or integrated with the controller 130. The output device 132 can include one or more of a signaling device 134, such as a light, a display, and a speaker, and/or a dunnage dispenser 150. The dunnage dispenser 150 is controlled by the controller 130 to dispense dunnage to the container 106. The dunnage dispenser 150 can include a dunnage converter having a conversion assembly that converts a stock material into a less dense dunnage object. For example, the dunnage converter might convert paper into a relatively thicker and less dense dunnage object, such as by crumpling, wadding, inwardly gathering, folding, and/or crimping, creasing, cutting and/or sealing the dunnage to hold its shape. Any type of dunnage is suitable for use with the present invention, including a fixed or expanding foam dunnage object, a cushioning dunnage object, a void-fill dunnage object, air bags, paper, cardboard, or any other type of dunnage or dunnage material. In an automated system the dunnage dispenser 150 may dispense dunnage directly to the container 106, or the dunnage dispenser 150 may dispense dunnage to a holding location so that the dunnage later can be placed in the container 106 in a semi-automated or manual packaging system.

The controller 130 controls the dunnage dispenser 150 to dispense a predetermined quantity of dunnage. The controller 130 can be integral to or separate from the dunnage dispenser 150, and may be remotely located to control one or more dunnage dispensers.

The packaging system 100 also typically includes a conveyor 170 that moves containers 106 past the sensor 114. The dunnage dispenser 150 is located next to the conveyor 170 and downstream of the sensor 114.

Figure 2:
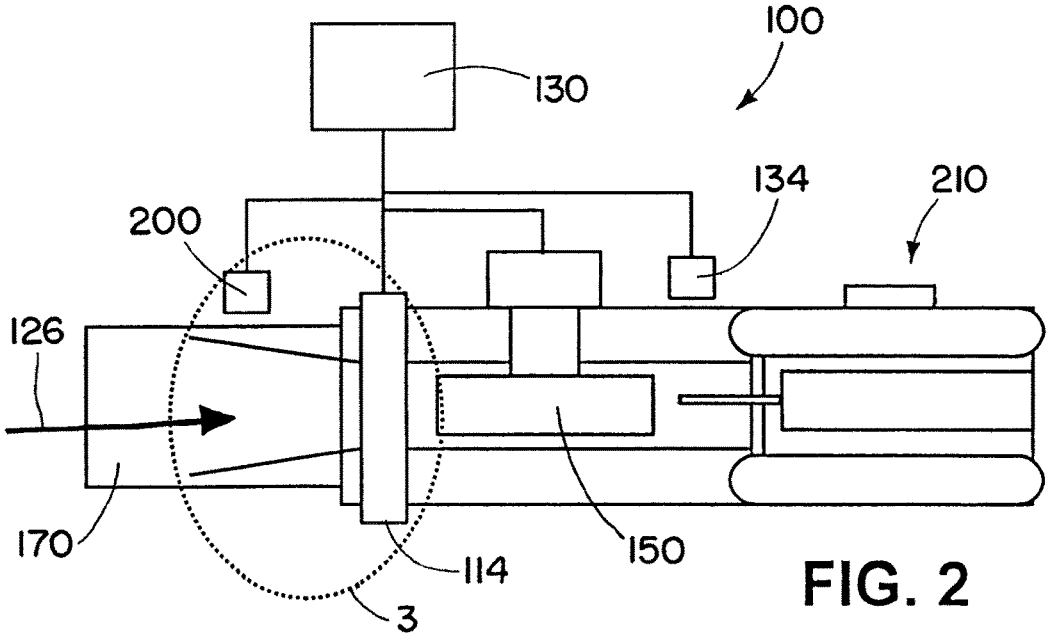
FIG. 2 is a top view of an exemplary system provided by the invention.
Figure 3:
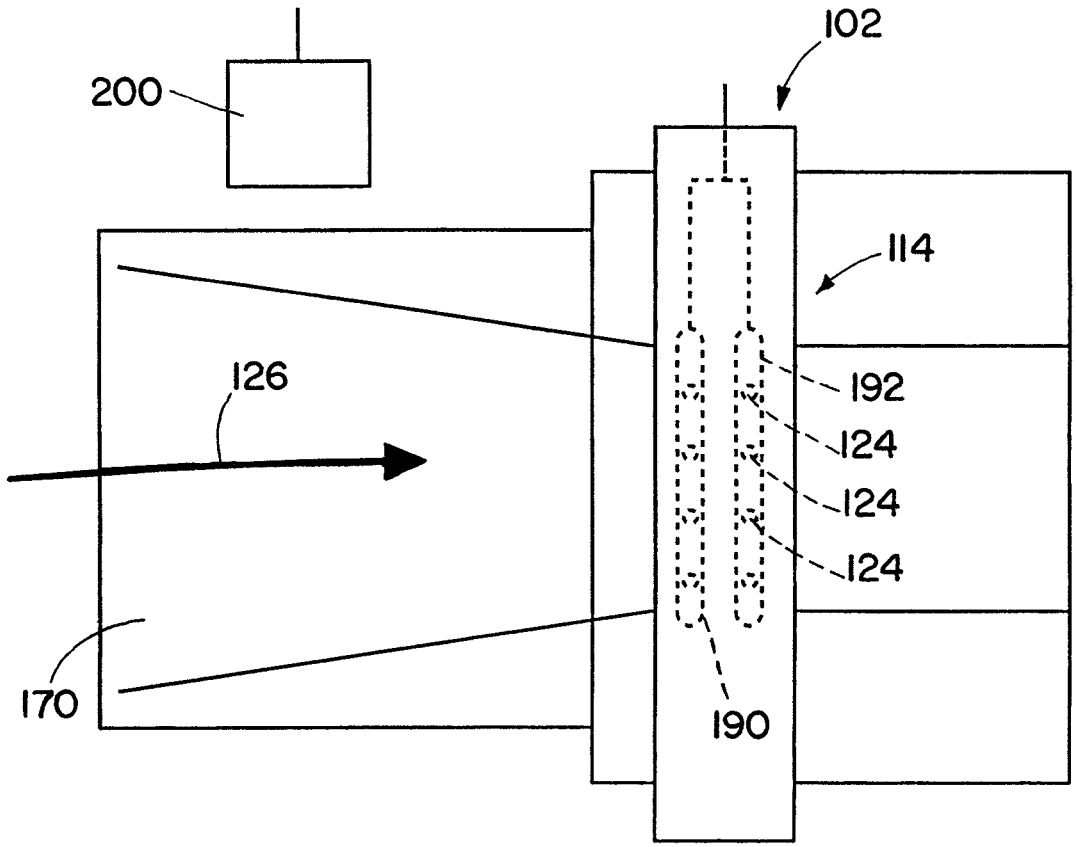
FIG. 3 is an enlarged top view of a sensor portion of the system shown in FIG. 2.

As shown in FIGS. 2 and 3, the sensor 114 can include a first sensor 190 that detects when a height of the contents in the container is greater than the height of the container and a second sensor 192 that detects when a height of the contents of the container is greater than a predetermined height that is less than the height of the container. Both the first sensor 190 and the second sensor 192 include a plurality of sensing elements 124 arrayed across the path 126 of the container 106 that look down into an open side of the container 106. The first sensor array 190 detects whether the height of the contents in a container exceed the height of the container, and the second array of sensing elements 192 detects whether the contents in the container exceed the predetermined height, or vice versa.

The attention of a packer is required when a detected height 104 is greater than the height of the container 106. In this situation the container 106 cannot be closed as the products 105 in the container extend above the height 136 of the container 106 (FIG. 1). The controller 130 can output a signal to the signaling device 134 for signaling when the detected height 104 is greater than the height 136 of the container 106 and alert a packer.

In an exemplary system, when a height 104 of one or more products that make up the contents 105 of the container exceeds the height 136 of the container 106, the controller 130 indicates that no dunnage should be dispensed. The controller 130 also alerts a packer to inspect the container. Now assume that the height 104 of the contents 105 is less than the height 136 of the container 106. If the height 104 of the contents 105 is less than the predetermined height 112, the controller 130 indicates that a normal quantity of dunnage should be dispensed. If, however, the height 104 of the contents 105 is less than the container height 136 but greater than the predetermined height 112, the controller 130 indicates that a minimal amount of dunnage, less than the normal amount, or no dunnage should be dispensed.

Finally, the system 100 can include a sensor 200 that identifies a container 106 and/or its contents 105 (FIG. 1) and is connectable to the controller 130. With the identifying sensor 200, the controller 130 can control the dunnage dispenser 150 based on the identified container. For example, different containers of different sizes can be associated with different predetermined criteria or different predetermined heights that are less than a respective container height. The sensor 200 can include a barcode reader, an image sensor and associated recognition software, a radio frequency identification device (RFID), etc.

A corresponding method provided in accordance with the invention includes the steps of (a) detecting a height 104 of contents in a container, and (b) indicating how much dunnage to dispense based on predetermined criteria.

The detecting step can include detecting whether any contents 105 in the container 106 have a height 104 that exceeds the predetermined height 112. The container height 136, which is known, also can be a predetermined height. So the detecting step can include detecting whether the height 104 of any of the contents 105 exceeds to the container height 136, either by measuring the height 104 or by detecting the presence of contents 105 above the predetermined height 112. The predetermined criteria can include a predetermined distance from the top of the container 106 or a predetermined percentage of the container height 136.

The indicating step includes indicating a quantity of dunnage to dispense selected from a plurality of predetermined quantities of dunnage. So, for example, the indicating step can include indicating a quantity of dunnage to dispense selected from zero dunnage, a minimal amount of dunnage, and a regular amount of dunnage greater than the minimal amount of dunnage. The indicating step can include comparing a detected height 104 and a predetermined height 112 that is less than a height 136 of the container 106. The indicating step can further include determining a quantity of dunnage to dispense, where (a) if no height 104 is greater than the predetermined height 112 that is less than the container height 136, indicating that the regular amount of dunnage should be dispensed, or (b) if a height 104 is greater than the predetermined height 112 and further predetermined criteria are satisfied, indicating whether zero dunnage or a minimal amount of dunnage should be dispensed. For example, in the determining step the predetermined criteria can include a percentage of an area of a bottom surface of a container. If the detected height over a predetermined percentage of the area exceeds the predetermined height 112, the method includes indicating that no dunnage should be dispensed. And conversely, below the predetermined percentage, the method includes indicating that the minimal amount of dunnage should be dispensed.

Additionally or alternatively, the indicating step can include signaling when a height greater than a height of the container has been detected.

The method also can include the steps of identifying a container and determining a quantity of dunnage to dispense based on the identified container. A twenty centimeter tall container might have a fifteen centimeter predetermined height, and a thirty centimeter tall container might have a twenty centimeter predetermined height, for example. And this changes the determination of how much dunnage to dispense for a particular detected height, such as eighteen centimeters. The method can also include the step of conveying containers past a sensor that detects the height of one or more objects in a container. And the conveying step can include conveying containers from a sensor 114 to a dunnage dispenser 115.

The method can also include the step of controlling a dunnage dispenser to dispense the indicated amount of dunnage to the container when the height 104 of the contents 105 in the container 106 is less than the predetermined height 112. The controlling step also can include controlling a dunnage converter 150 to convert a stock material, such as paper, into a relatively thicker and less dense dunnage product. In an automated or semi-automated system, the conveyor can then transport or convey the container from the dunnage dispenser to a closing station 210 (FIG. 2) that closes and/or seals the container, such as by folding the flaps inward and taping the flaps in the closed position, or placing and sealing a lid on the container.

Although the invention has been shown and described with respect to an exemplary embodiment, equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure, that performs the function in the illustrated exemplary embodiment provided by the invention.

We claim:

1. A packaging method, comprising the steps of:

(a) defining predetermined criteria, including (i) a predetermined height that is less than the height of a container, and (ii) a plurality of predetermined quantities of dunnage;

(b) detecting a height of contents in the container;

(c) comparing the detected height and the predetermined height; and (d) indicating a quantity of dunnage to dispense selected from the plurality of predetermined quantities of dunnage based on the comparison between the detected height and the predetermined height.

2. A method as set forth in claim 1, wherein the detecting step includes detecting whether any contents in the container have a height above the predetermined height.

3. A method as set forth in claim 1, wherein the indicating step includes indicating a quantity of dunnage to dispense selected from zero dunnage, a minimal amount of dunnage, and a regular amount of dunnage greater than the minimal amount of dunnage.

4. A method as set forth in claim 3, wherein the indicating step includes determining a quantity of dunnage to dispense, where (a) if no detected height is greater than the predetermined height, determining that the regular amount of dunnage should be dispensed; or (b) if a detected height is greater than the predetermined height, determining whether zero dunnage or a minimal amount of dunnage should be dispensed based on an additional predetermined criteria.

5. A method as set forth in claim 4, wherein when a detected height is greater than the predetermined height, the determining step includes determining whether the detected height over a predetermined percentage of a cross-sectional area of the container exceeds the predetermined height, whereby (a) if the detected height exceeds the predetermined height more than the predetermined percentage, determining that no dunnage should be dispensed, and (b) if the detected height exceeds the predetermined height less than the predetermined percentage, determining that the minimal amount of dunnage should be dispensed.

6. A method as set forth in claim 1, wherein the indicating step includes signaling when the detected height is greater than a height of the container.

7. A method as set forth in claim 1, comprising the steps of identifying the container and determining the quantity of dunnage to dispense based on the identified container.

8. A method as set forth in claim 1, comprising the step of conveying containers past a sensor that detects the height.

9. A method as set forth in claim 8, wherein the conveying step includes conveying containers from a sensor to a dunnage dispenser.

10. A method as set forth in claim 1, comprising the step of controlling a dunnage dispenser to dispense the indicated amount of dunnage to the container when the detected height is less than the height of the container.

11. A method as set forth in claim 10, wherein the controlling step includes controlling a dunnage converter to convert a stock material into a dunnage object.

12. A method as set forth in claim 11, wherein the converting step includes converting a sheet of paper to a relatively thicker and less dense dunnage object.

13. A packaging method comprising the steps of:

(a) defining predetermined criteria, including (i) a predetermined height that is less than the height of a container, (ii) one or more ranges of heights wherein one of the ranges of heights is between a predetermined height that is less than the height of a container and the height of a container, and (iii) a plurality of predetermined quantities of dunnage to dispense for each range of heights, including a zero dunnage, a minimal amount of dunnage, and a normal amount of dunnage that is greater than the minimal amount of dunnage, (b) detecting whether contents in a container have a height above the predetermined height; and (c) indicating a quantity of dunnage to dispense selected from the plurality of predetermined quantities of dunnage based on whether the detecting step detected contents of the container above the predetermined height, wherein the detecting step (b) includes (i) detecting whether the contents have a height above a height of the container; and (ii) detecting whether the contents have a height above the predetermined height that is less than the height of the container.

* * * * *